United States Patent [19]

Houk, Jr.

[11] 4,332,044

[45] Jun. 1, 1982

[54] ASSEMBLY FOR FILLING AND EMPTYING A WATER BED

[76] Inventor: Leroy M. Houk, Jr., 3908 Calle Andalucia, San Clemente, Calif. 92672

[21] Appl. No.: 141,338

[22] Filed: Apr. 18, 1980

[51] Int. Cl.[3] ..... A47C 27/00

[52] U.S. Cl. ..... 5/453; 5/451

[58] Field of Search ..... 5/453, 451, 452, 454; 417/181

[56] References Cited

U.S. PATENT DOCUMENTS

| | | | |
|---|---|---|---|
| 1,105,985 | 8/1914 | McClymont . | |
| 1,212,004 | 1/1917 | Berg | 417/181 |
| 1,232,883 | 7/1917 | Armstrong | 417/181 |
| 1,570,128 | 1/1926 | Carter | 5/451 X |
| 2,000,873 | 5/1935 | Arens | 5/453 X |
| 2,928,354 | 3/1960 | Bones . | |
| 3,470,826 | 10/1969 | Foulds | 417/181 |
| 3,797,538 | 3/1974 | Mollura . | |
| 3,849,814 | 11/1974 | Ross . | |
| 3,958,286 | 5/1976 | Rodinsky | 5/451 X |
| 3,980,138 | 9/1976 | Knopik | 166/75 R X |

*Primary Examiner*—Stephen J. Novosad
*Assistant Examiner*—George A. Suchfield
*Attorney, Agent, or Firm*—Gausewitz, Carr, Rothenberg & Edwards

[57] ABSTRACT

An assembly is described for filling a water bed mattress or pumping the contents therefrom. The assembly includes a siphon pump which is attached directly to the mattress outlet and may be secured to an integrally formed storage chamber in the mattress and stored therein when not in use. Collapsible conduit can be used with the siphon pump and the integrally formed storage chamber may also include storage facilities for the collapsible conduit.

10 Claims, 5 Drawing Figures

FIG. 3.
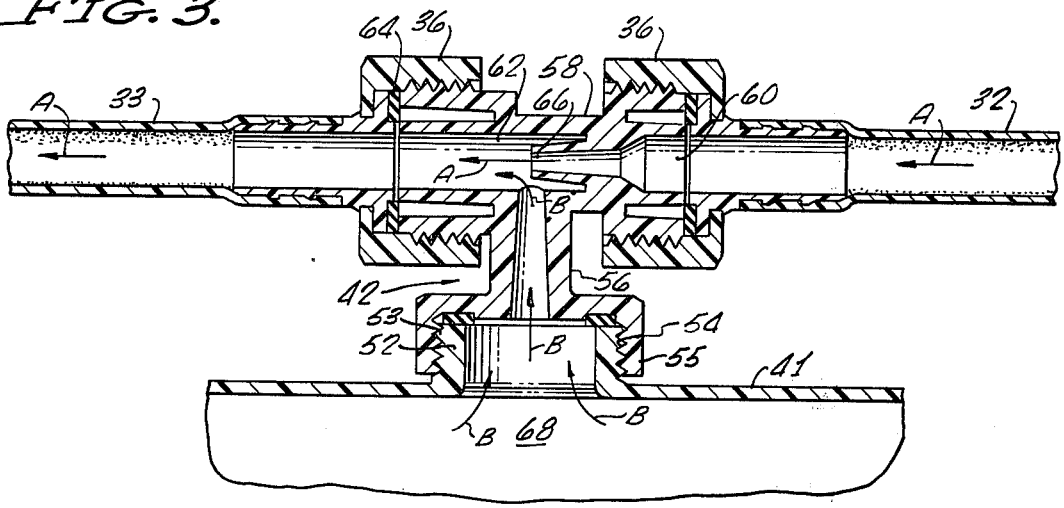
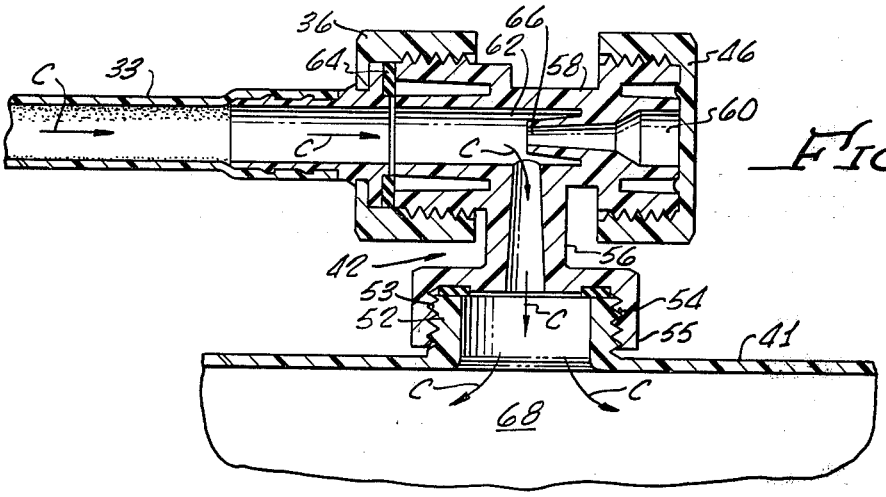
FIG. 4.
FIG. 5.
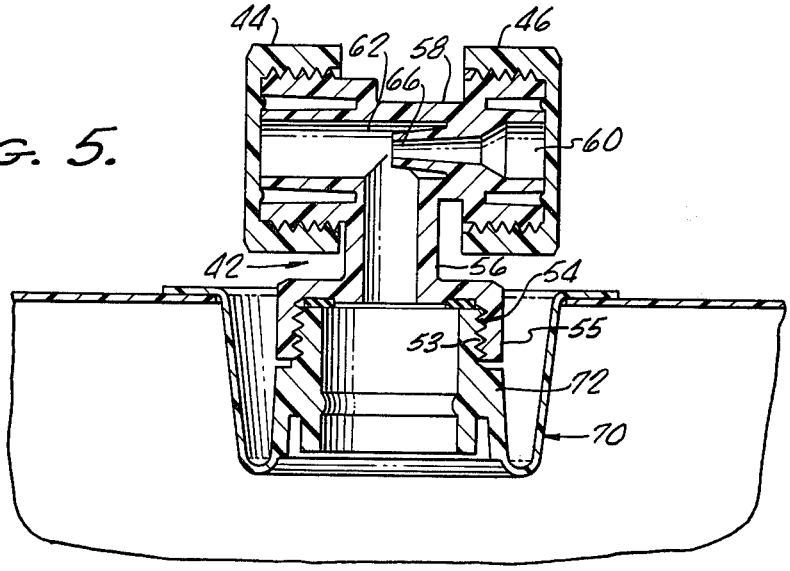

ASSEMBLY FOR FILLING AND EMPTYING A WATER BED

BACKGROUND OF THE INVENTION

This invention relates to apparatus for filling and emptying water beds.

Water beds have been used for many years as an improved, buoyant, supporting mattress capable of distributing support to adapt to the weight and conform to the shape of all portions of the human body. Typically, water bed mattresses consist of a flexible, hollow plastic shell which is collapsible and is shaped substantially similar to a conventional mattress when filled with water. Very high quality mattresses have been made for years, typically of vinyl plastics or similar material, and such mattresses are capable of providing many years of excellent service. However, substantial problems have persisted for many years in the method and apparatus used for filling and draining water beds.

Typically, a water bed mattress has an opening in the upper surface through which water can be added or withdraw. To add water (or other additives such as fungicides), one connects a hose to the outlet of the opening and fills the mattress to the desired capacity. While apparently a simple operation, this can lead to undesired results. For example, if the water supply suddenly fails, a partial vacuum on the water line may be created which draws the contents out of the mattress and into municipal water lines. This can be a potential health hazard where fungicides or other chemicals in the mattress are drawn into the water lines.

Problems are also encountered in draining a water bed mattress, for example, to move it, repair it, or to put in fresh water or fungicide. To drain the mattress, it is necessary to withdraw the contents, typically by pumping the liquid out of the opening in the upper surface. The types of apparatus for achieving this have been inconvenient and unwieldy. Moreover, since water beds are typically drained only at infrequent intervals, perhaps even several years, it has been necessary to store the drainage pump and other associated equipment for long periods between use, with the attendant risk of misplacing one or more components and the necessity for maintaining external storage space.

Typically, water bed mattresses are drained by use of a venturi type pump such as that shown, for example, in U.S. Pat. No. 3,456,270, to Weinstein, et al. Such pumps may consist of a T-shaped arrangement wherein one end of the cross arm of the T is connected to a water faucet, and the other end extends downwardly to a sink. Water is injected at a high flow rate through the vertically positioned cross arm of the T, causing a siphoning effect to draw a partial vacuum on the leg of the T. A hose is connected to the leg of the T and then inserted in the opening in the top of a water bed mattress, or attached to the outlet of the mattress. The partial vacuum gradually draws the liquid contents from the mattress and allows the mattress to collapse as it is emptied.

In typical use, water beds are not located near a faucet and sink, or other drain, and it is necessary to convey the contents of the mattress a substantial distance through the hose of the sink. Thus, very high vacuums must be drawn to effectuate the removal. Consequently, it is often necessary to pump the contents for substantial periods, often in excess of 2 hours to drain a normal size water bed. Further, it is necessary to use a hose or conduit which is flexible enough to bend around corners yet of high radial rigidity, since nonrigid conduits will collapse under vacuums and prevent the withdrawal of the liquid. Typically, a bulky and unwieldy garden-type hose is used for this purpose. Moreover, as previously noted, storage space must be provided for keeping the pump and bulky hose perhaps for many years, until the mattress is drained again.

It is an object of the present invention to overcome these problems of the prior art, and to provide a means and apparatus for rapidly, safely, and efficiently draining and filling water bed mattresses, and to provide apparatus which can be stored in minimal space. In its preferred embodiments, it is an object of the present invention to provide apparatus which can be integrally stored within the mattress itself.

SUMMARY OF THE INVENTION

This invention contemplates an assembly for filling and emptying a water bed mattress by providing a pump adapted for direct attachment to an opening in the top of the mattress without the necessity for using a flexible conduit between the mattress and the pump. The pump is connected to the mattress through a conduit whose length is substantially less than the thickness of the mattress when the mattress is filled to normal capacity. The conduit may be substantially rigid tubing integrally formed with the pump. The pump is an injector or venturi type pump which employs water injection at household pressures to draw vacuums of at least about 2 inches of water.

In a particularly preferred embodiment, the invention may include a detachable, flexible, radially collapsible conduit for connection to a water supply, and a storage means integrally formed with, or attached to, the mattress body for storing the pump and collapsible conduit when they are not in use.

BRIEF DESCRIPTION OF THE DRAWINGS

FIG. 3 is a transverse sectional view taken along line 3—3 of FIG. 2, showing the pump in drain mode for emptying the mattress.

FIG. 4 is a view similar to FIG. 3, except the pump is in fill mode for filling the mattress.

FIG. 5 shows an alternative assembly in which the pump is used with a conventional water bed mattress.

DETAILED DESCRIPTION OF THE INVENTION

Figure 1:
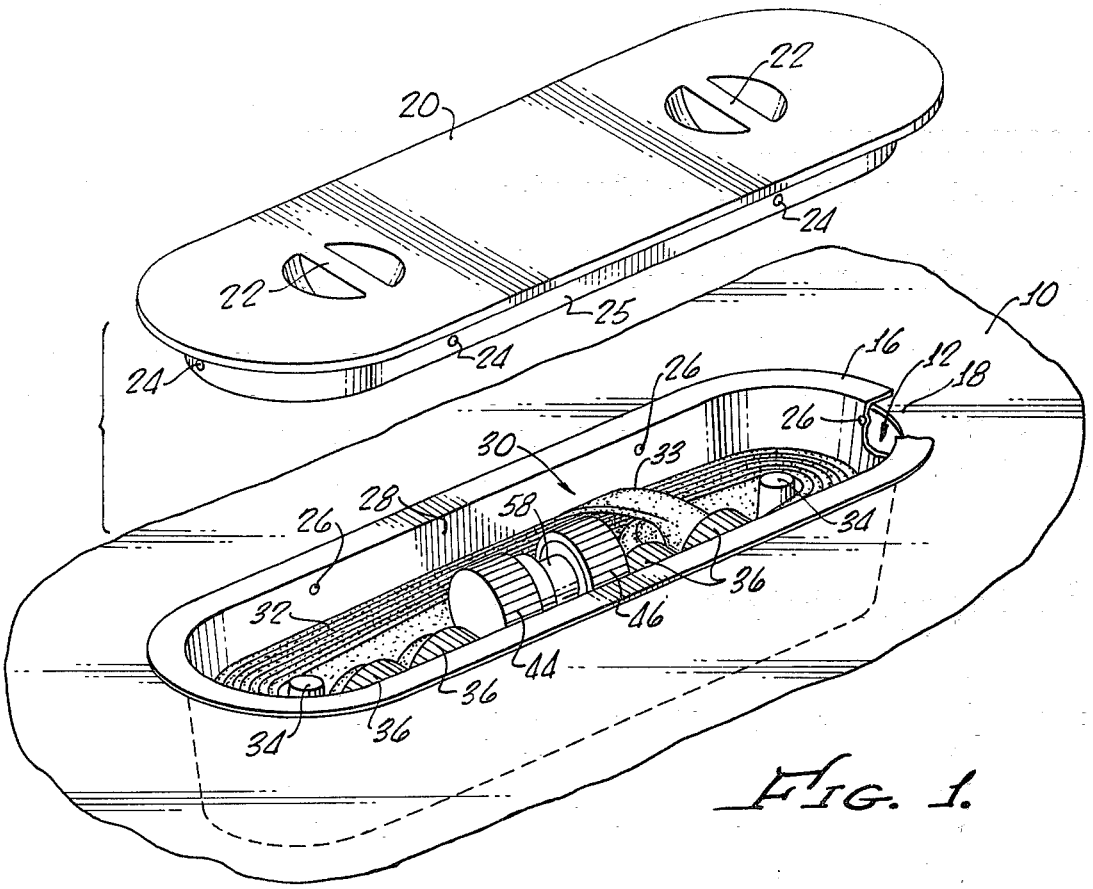
FIG. 1 is a fragmentary exploded perspective view of a water bed mattress provided with the pump and conduit assembly stored in an integrally formed chamber in the mattress body.
Figure 2:
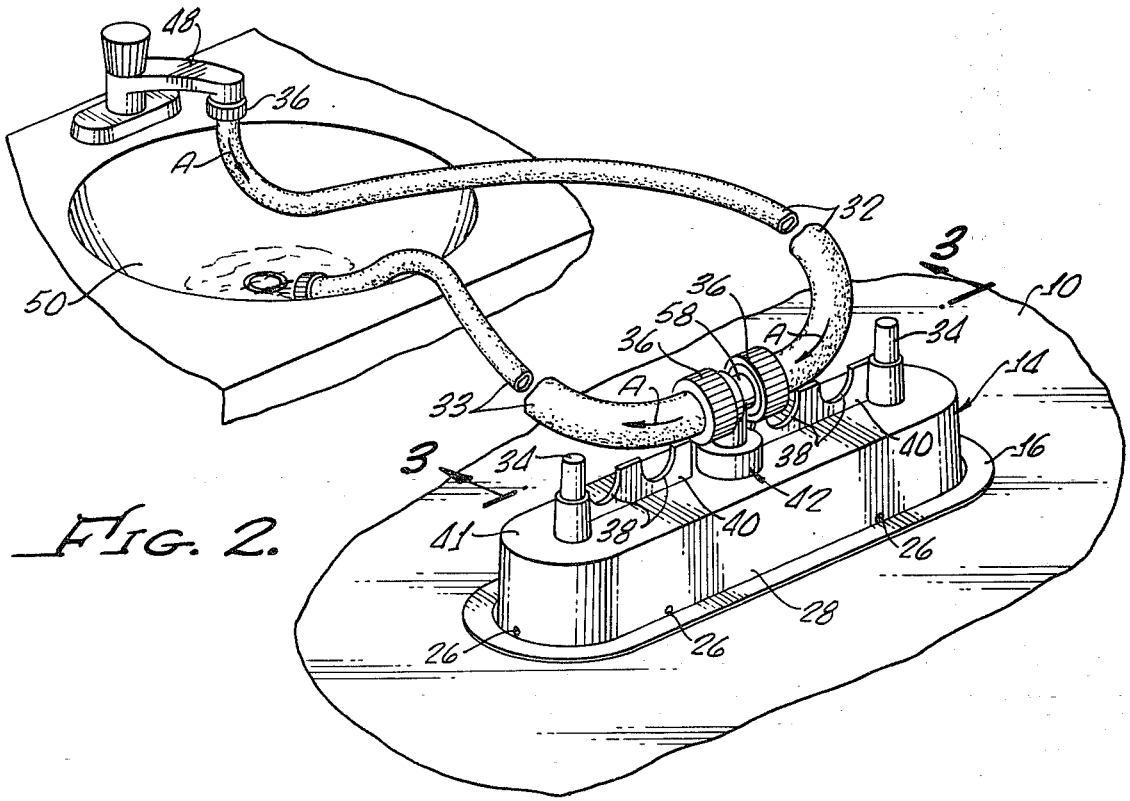
FIG. 2 is a perspective view of the invention in operation emptying the water bed mattress.

FIGS. 1 and 2 illustrate a preferred embodiment of the invention wherein the entire pump assembly is adapted to be stored in an integrally formed chamber within the mattress itself. The upper surface 10 of a water bed mattress is provided with an oval opening 12 which ranges in length from about 6 inches to 12 inches and in width from about 2 inches to 12 inches. The water bed mattress may be typically made of a heavy gauge vinyl or other plastic material, as is well known in the art.

A pump housing 14 is thermally or adhesively bonded by means of a flange 16 to edge portion 18 of the upper surface 10 of the water bed mattress. The flange 16 is sized to extend at least about 3/16 inch, and preferably about ⅜ inch to 2 inches, over edge portion 18. Typically, the flange portion should range from about 10 mils to 50 mils in thickness to provide a sufficiently strong and durable connection to the upper surface of the water bed mattress to insure adequate durability. The pump housing 14 is preferably composed of a flexible vinyl or other plastic material which can be injection molded as a unitary component. However, it is also contemplated to make housing 14 by bonding subcomponents together or by molding the entire pump housing as an integral part of the water bed mattress itself. The pump housing 14 is eversible and sufficiently flexible to evert from a recessed position, as shown in FIG. 1, to a raised position, as shown in FIG. 2.

A pump housing cover 20, having integrally formed handles 22, is sized compatibly to fit and cover cavity 30 formed by housing 14 in recessed position. The cover 22 is preferably composed of a plastic which can be injection molded as a single component and is sufficiently resilient and flexible to permit the user of the water bed to contact it without physical discomfort, but sufficiently rigid to prevent it from being so deformed under normal forces when in use as to force it downwardly into contact with the contents stored in pump housing 14 as shown in FIG. 1.

The cover 20 is provided with bosses 24 along its lower body 25. The bosses are sized and positioned for compatible engagement with dimples 26 in the wall 28 of pump housing 14. Thus, when the water bed mattress is filled with liquid and intended for use, the cover 20 can be pressed in position with the bosses 24 snapping into engagement with the dimples 26 to retain the cover in a secure, closed position. When access to the interior of the pump housing 14 is desired, one merely grasps the handles 22 and pulls upwardly on the cover to disengage the bosses 24 from dimples 26.

As shown in FIG. 1, when the pump housing 14 is to be used as an internal storage facility inside the water bed mattress, the housing 14 is everted down into the mattress with only the flange 16 extending above the upper surface 10 of the mattress. When the housing is everted into this recessed position, it forms a storage cavity 30 having an interior length ranging preferably from about 6 inches to 12 inches and a width ranging preferably from about 2 inches to 12 inches, sufficient to store hoses 32 and 33. The cavity 30 should have a depth sufficient for storage purposes but less than the thickness of the water bed mattress when it is filled to its normal operating capacity. Preferably, the depth of cavity 30 should be no greater than approximately 50% of the thickness of the mattress and typically should range from about 1 inch to 8 inches in depth.

The hoses 32 and 33 are soft-bodied nonrigid collapsible hoses and can be made of any suitable plastic or other material capable of being easily collapsed into flat cross sections or ribbons for storage. The hoses are stored as shown in FIG. 1 by winding them about the integrally formed posts 34 of the pump housing 14. The posts 34 are positioned a sufficient distance from the wall 28 of the housing 14 to permit the flattened hoses to be wound around them and have sufficient space for the full lengths of the hoses to be stored. For typical hoses having diameters in the range from about 3/16 inch to 2 inches and lengths ranging from about 10 feet to 50 feet, the hoses can fit properly if the posts are about 4 to 10 inches apart and have about ½ inch to 6 inches of space between the posts and the wall 28.

For storage of the hoses, the hose couplings 36 are nested against retaining notches 38 in the integrally formed stiffening walls 40 extending upwardly from base 41 of the housing 14. The stiffening walls 40 run from the integrally formed posts 34 toward the center of the housing 14, terminating before reaching the position of the pump 42. The stiffening walls 38 provide desirable rigidity to the base 41, and the total length of the two walls runs preferably from about 30% to 60% of the length of the housing 14. The maximum wall height should be no greater than the height of the posts 34 and preferably range from about 1 inch to 4 inches. Retaining notches 38 are of sufficient depth to engage and retain the hoses just adjacent and behind the end of the hose couplings 36.

When the pump 42 is in use for emptying water or other liquid from the water bed mattress, hoses 32 and 33 may be connected to the pump as shown in FIG. 2. When the pump is not in use, the hoses are disconnected and stored as shown in FIG. 1, the caps 44 and 46 are threadably engaged on the inlet and outlet of the pump to seal it and prevent leakage of the liquid when the mattress is used. When the pump is in the upwardly extended position shown in FIG. 2, either cap 44 or 46 may also be loosened to bleed off any air bubbles which may have accumulated from dissolved air in the liquid. This is desirable to prevent sloshing when the mattress is in use.

FIGS. 2 and 3 illustrate the use of the invention to drain the mattress by pumping the liquid therefrom. FIG. 3 shows the pump 42 in enlarged cross section, and the arrows in FIGS. 2 and 3 indicate the direction of fluid flow.

As shown in FIG. 2, the hose 32 is connected to a faucet or other water source 48 and hose 33 runs to a drain or sink 50.

As shown in FIG. 3, the base 41 of housing 14 has an upwardly extending, externally threaded tubular nipple 52 integrally connected to base 41. The external threading 53 of nipple 52 is adapted to threadably engage the interior threading 54 of base coupling 55 of venturi pump 42. Base coupling 55 is connected to suction tube 56 to provide a fluid conduit to the body 58 of the pump.

Preferably, the suction tube 56 has an internal cross-sectional area greater than the cross-sectional area of the inside of the body 58 of the pump. Also, to insure minimal loss of suction through the tube 56, the tube should be less than about 8 inches in length, and preferably less than about 50% of the depth of storage cavity 30 to insure that the pump will fit in the cavity without contacting the cover 20 with excessive force when normal loads are placed upon the upper surface of the mattress and pump housing cover.

To drain a water bed mattress equipped with the assembly of this invention, one merely grips the handles 22 of housing cover 20 and lifts the cover away to expose the contents of storage cavity 30. The pump housing 14 is then everted by gripping the pump 42 and pulling upwardly to turn wall 28 inside out as shown in FIG. 2. Caps 44 and 46 are then removed from the pump 42, and hoses 32 and 33 are removed from the storage cavity and attached to the inlet side 60 and outlet side 62 by couplings 36, as shown in FIG. 3. The couplings 36 are equipped with washers 64 to insure a seal and prevent leakage. The hose 32 to the inlet side 60 of the pump is then connected to a water source such as faucet 48, and the outlet hose is positioned in a drain or sink 50. The water supply is turned on and water flows to and through the pump 42, as shown by the arrows A. The flow through the venturi portion 66 of pump 42 creates a partial vacuum and draws the liquid 68 in the mattress upwardly through tubular nipple 52 and suction tube 56, and into outlet 62 of the body 58 of the pump, as shown by arrows B. There, the liquid 68 mixes with the water flowing through the pump and is carried out to the drain 50 through hose 33.

Since the mattress is nonrigid, it collapses as the liquid 68 is removed, and, thus, can be completely drained by the pump 42 positioned on its upper surface.

To refill the mattress with water, one may merely remove the hose 33 from the outlet 62 of pump 14 and seal the outlet side with cap 44. Then, the water passing through the venturi portion 66 of the pump when the faucet is turned on will pass downwardly through suction tube 56 into the mattress. However, since the venturi portion of the pump is generally of a small cross section and has a somewhat restricted flow capacity, the filling process can be expedited by reversing the water flow. To achieve this, the hose 32 is removed from the inlet side of the pump, which is then sealed with cap 46 as shown in FIG. 4. The hose 33 from the outlet side is attached to a water source (not shown in FIG. 4), and when the water is turned on, the flow direction is, as shown by arrows C, inwardly through the outlet side of the pump and downwardly through suction tube 56 and tubular nipple 52 into the mattress. The greater cross section in the outlet side of the pump permits a high flow rate through the pump and into the mattress.

In a particularly preferred embodiment, the hoses 32 and 33 are sufficiently soft and collapsible that if, during the filling operation, the source water pressure fails and a partial vacuum is created in either hose, the hose will collapse and seal itself. This acts as a check valve and prevents the contents of the mattress from being siphoned out to contaminate the source water lines.

It is also contemplated to employ the pump of this invention on conventional water bed mattresses having an outlet on the upper surface of the mattress with a compatible nipple to fit base coupling 55 of the pump. Such outlets are typically known as "Roberts" valves. FIG. 5 shows the use of the pump arrangement of this invention with such a conventional water bed mattress. Therein is shown the conventional outlet 70 which includes a vertical nipple 72 to which a pump 42 is secured by means of base coupling 55. The use of the pump to fill and drain the mattress is substantially the same as discussed above in relation to FIGS. 2 and 3. However, since no storage capability is provided in conventional mattresses, it is necessary upon completion of the filling or draining that the pump 42 be removed from outlet 70 and the outlet capped by separate means (not shown).

It is a particularly important advantage of the invention that all the hoses used in connection with the pump assembly may be of the collapsible, nonrigid type. This has heretofore not been feasible with any other known assemblies for draining water bed mattresses. Only radially rigid hoses can be used to connect the mattress outlets with a conventional pump means positioned at a water source some distance away from the mattress, since in such use collapsible hoses will collapse and seal the suction side during operation. It has also been unfeasible to store noncollapsible hoses in the water bed mattress due to the large bulk of hoses of any significant length. A particularly preferred type of hose is a 7 mil polyurethane tube $\frac{5}{8}$ inch in inside diameter, reinforced with a surrounding synthetic woven or braided fabric tubing 1 inch wide (measured flat), but any other collapsible type hoses are contemplated as useful in practicing the invention. Preferably, the hoses on the intake side of the pump will range about 3/16 inch to about 1 inch in inside diameter, while those on the discharge side will range from about $\frac{1}{4}$ inch to about 2 inches, depending on water pressure, hose lengths, and the particular discharge rates desired.

Any suitable injector or venturi pump may be used in the invention. A compact pump whose inlet, discharge, and suction tubes or legs each measured less than about 2 inches, made from acrylonitrile-butadiene-styrene (ABS) plastic, has been found to be excellent, but any conventional materials of construction are also contemplated as being useful in the invention.

It will be apparent to those skilled in the art that the invention herein is subject to many variations. Accordingly, the foregoing detailed description is to be understood as given by way of illustration and example only, the spirit and scope of this invention being limited solely by the attached claims.

What is claimed is:

1. In a mattress of a type having a flexible, hollow, collapsible shell adapted for filling with liquid to provide buoyant shape-conforming support for the user thereof, the improvement comprising:

a venturi pump of the type having an inlet side, an outlet side, and a suction conduit, for emptying liquid from said mattress;

a pair of flexible hoses adapted for detachable fluid communication with the inlet side and the outlet side of said pump, said hoses being sufficiently radially nonrigid to be collapsed into coils having substantially flat cross sections for storage; and a housing disposed in said shell, said housing having a cross sectional area and depth sufficient to store said pump and hose coils without any portion thereof extending beyond the outer surface of said shell when the mattress is filled with liquid.

2. The invention of claim 1 wherein said housing comprises an eversible chamber adapted to be flexed between a recessed position to form a cavity within said mattress and an extended position to form a pump support which supports said pump outside said mattress.

3. The invention of claim 2 wherein said eversible chamber is disposed within the upper surface of said mattress and comprises a generally horizontal base and substantially vertical walls, said walls being connected around their periphery to said upper surface, said horizontal base being recessed within said mattress when the chamber is in recessed position and being extended outwardly beyond said upper surface when said chamber is in extended position.

4. The invention of claim 3 wherein said base is positioned a distance below the surface of said mattress no more than 50% of the depth of liquid therein, when said chamber is in recessed position.

5. The invention of claim 3 wherein said chamber comprises a flexible plastic member bounded at its periphery to the upper surface of said mattress and said base includes a stiffening rib integrally formed therewith.

6. The invention of claim 5 wherein said chamber ranges from about 6 to about 12 inches in length and said stiffening rib runs longitudinally along said base and ranges from about 30% to about 60% of the length thereof.

7. The invention of claim 3 wherein there is included in said chamber a means adapted for maintaining said hoses in coiled position when the hoses are stored therein.

8. The invention of claim 3 including a removable cover for said chamber adapted to be secured thereto when said chamber is in recessed position.

9. The invention of claim 3 wherein said hoses range in length at least above 10 feet and range in inside diameter at least about 3/16 inch.

10. The invention of claim 1 wherein said hoses are sufficiently nonrigid radially that they will collapse under partial vacuum sufficiently to prevent the flow of water therethrough.

* * * * *